US006029407A

United States Patent [19]

Schillero, Jr.

[11] Patent Number: 6,029,407

[45] Date of Patent: Feb. 29, 2000

[54] METAL STUD HOLDING DEVICE

[75] Inventor: Samuel L. Schillero, Jr., Northfield, Ohio

[73] Assignee: S&S Interiors, Inc., Northfield, Ohio

[21] Appl. No.: 09/208,565

[22] Filed: Dec. 9, 1998

[51] Int. Cl.[7] ..... E04G 17/04

[52] U.S. Cl. ..... 52/127.2; 52/DIG. 1; 52/DIG. 4; 52/749.1; 269/8; 269/41; 248/351

[58] Field of Search ..... 52/127.2, DIG. 1, 52/146, DIG. 4, 749.1; 248/351; 269/8, 41

[56] References Cited

U.S. PATENT DOCUMENTS

| | | | |
|---|---|---|---|
| D. 243,853 | 3/1977 | Ejchorszt | 52/146 |
| D. 365,749 | 1/1996 | Pacheco . | |
| 2,969,819 | 1/1961 | Bravo | 52/749.1 |
| 3,574,981 | 4/1971 | Henschen | 52/749.1 |
| 3,616,514 | 11/1971 | Laverty | 52/749.1 |
| 3,686,815 | 8/1972 | Von Bose | 52/DIG. 4 |
| 3,726,501 | 4/1973 | Trentmann | 248/351 |
| 3,817,006 | 6/1974 | Williams | 52/749.1 |
| 4,068,427 | 1/1978 | Camardo | 52/98 |
| 4,452,336 | 6/1984 | Sickler . | |
| 5,163,233 | 11/1992 | Benson . | |
| 5,634,301 | 6/1997 | Koller | 52/DIG. 4 |

*Primary Examiner*—Carl D. Friedman
*Assistant Examiner*—Dennis L. Dorsey
*Attorney, Agent, or Firm*—Fay Sharpe Fagan Minnich & McKee

[57] ABSTRACT

An apparatus for holding a metal stud during wall construction comprises a frame including a pair of spaced-apart longitudinal members generally parallel to each other, a first cross member extending between the longitudinal members, a second cross member located at an intermediate position between the longitudinal members, and at least one stud magnet magnetically engageable with a metal stud. A base member adapted to engage a stud track is connected to the frame. The frame is disposable relative to the base member to position the metal stud substantially orthogonal to the stud track. The longitudinal members and the first cross member can comprise a unitary U-shaped member. The base member can be comprised of a pair of spaced-apart arms pivotably connected to the second cross member. The base member can further comprise a third arm pivotably connected to the pair of arms which pivots between a storage position and a working position. A method for erecting a metal wall partition is also provided.

19 Claims, 5 Drawing Sheets

METAL STUD HOLDING DEVICE

BACKGROUND OF THE INVENTION

The present invention relates to stud holders. More particularly, it relates to an improved stud holder for use with aligning and installing metal studs.

During installation of metal studs, the stud is typically connected between a lower track and upper track of a wall partition. The operation of aligning and securing the stud in place usually requires two workers. One worker holds the metal stud in place in a generally vertical position within the lower track, while the other worker secures the upper track to the top end of the stud. The cost of union labor is very expensive. Thus, if only one worker instead of two is required to install a metal stud, a significant cost savings can be realized. In addition, time savings would result because labor can be reallocated to functions other than holding metal studs into position. Also, if only one worker could install a metal stud without relying on a second person to hold the stud into position, do-it-yourselfers would be able to install metal studs at home without needing a second person's assistance.

This invention is intended to provide a device that can hold metal studs in place so a single worker can assemble a wall partition. Additional advantages of the present invention will be set forth in part in the description that follows, and in part will be obvious from that description or can be learned by practice of the invention. The advantages of the invention can be realized and obtained by the apparatus and method particularly pointed out in the appended claims.

SUMMARY OF THE INVENTION

The present invention overcomes the problems of prior art methods of assembling wall partitions from metal studs by providing a frame with magnetic members to hold a metal stud in a vertical position within a lower track during assembly.

To overcome the problems of the prior art assembly methods, and in accordance with the purpose of the invention, as embodied and broadly described herein, the apparatus of this invention for holding a metal stud during wall construction comprises a base member adapted to engage a stud track and a frame including a stud magnet magnetically engageable with a metal stud. The frame is connected to the base member and is moveable relative to the base member to position the metal stud substantially orthogonal to the stud track.

In the preferred embodiment, the frame includes a pair of spaced-apart longitudinal members generally parallel to each other, a first cross member extending between the longitudinal members, and a second cross member located at an intermediate position between the longitudinal members. The frame further includes two stud magnets which are magnetically engageable with a metal stud. Preferably, the frame is pivotably connected to the base member.

If desired, the longitudinal members and the first cross member can comprise a unitary U-shaped member, and the base member can comprise a pair of spaced-apart arms pivotably connected to the second cross member. In addition, the base member can comprise a third arm pivotably connected to the pair of arms between a storage or folded position and a working or open position. The base member can include a track magnet magnetically engageable with the metal stud track.

One advantage of the present invention is the provision of a metal stud holding device including a frame with at least one stud magnet magnetically engageable with a metal stud, and a base member adapted to engage a stud track and connected to the frame.

Another advantage of the present invention is the provision of a metal stud holding device wherein the base member is pivotably connected to the frame to collapse the metal stud holding device from a working position to a folded or storage position.

Other advantages of the holder are its ease of use, convenience, light weight, ease of storage, stability, durability, and reduced manpower and associated costs. Carpenters, construction workers, and do-it-yourselfers can use this device to simplify the task of erecting metal wall partitions.

The holder will be cost-effective since one worker could erect the metal wall partition alone. The higher labor costs of paying two workers would not be necessary, saving contractors and companies money.

The holder would typically be fabricated from hardened steel, but would still be light enough to easily carry to a work site and position against a stud. The swiveling support arm would also allow the holder to be folded into a compact unit that would make the holder easy to store in a truck or in a work shed.

Still other advantages and benefits of the invention will become apparent to those skilled in the art upon a reading and understanding of the following detailed description.

BRIEF DESCRIPTION OF THE DRAWINGS

The accompanying drawings, which are incorporated in and which constitute a part of this specification, illustrate at least one embodiment of the invention and, together with the description, explain the principles of the invention.

DETAILED DESCRIPTION OF THE PREFERRED EMBODIMENT

Reference now will be made in detail to the presently preferred embodiments of the invention, examples of which are illustrated in the accompanying drawings.

Figure 1:
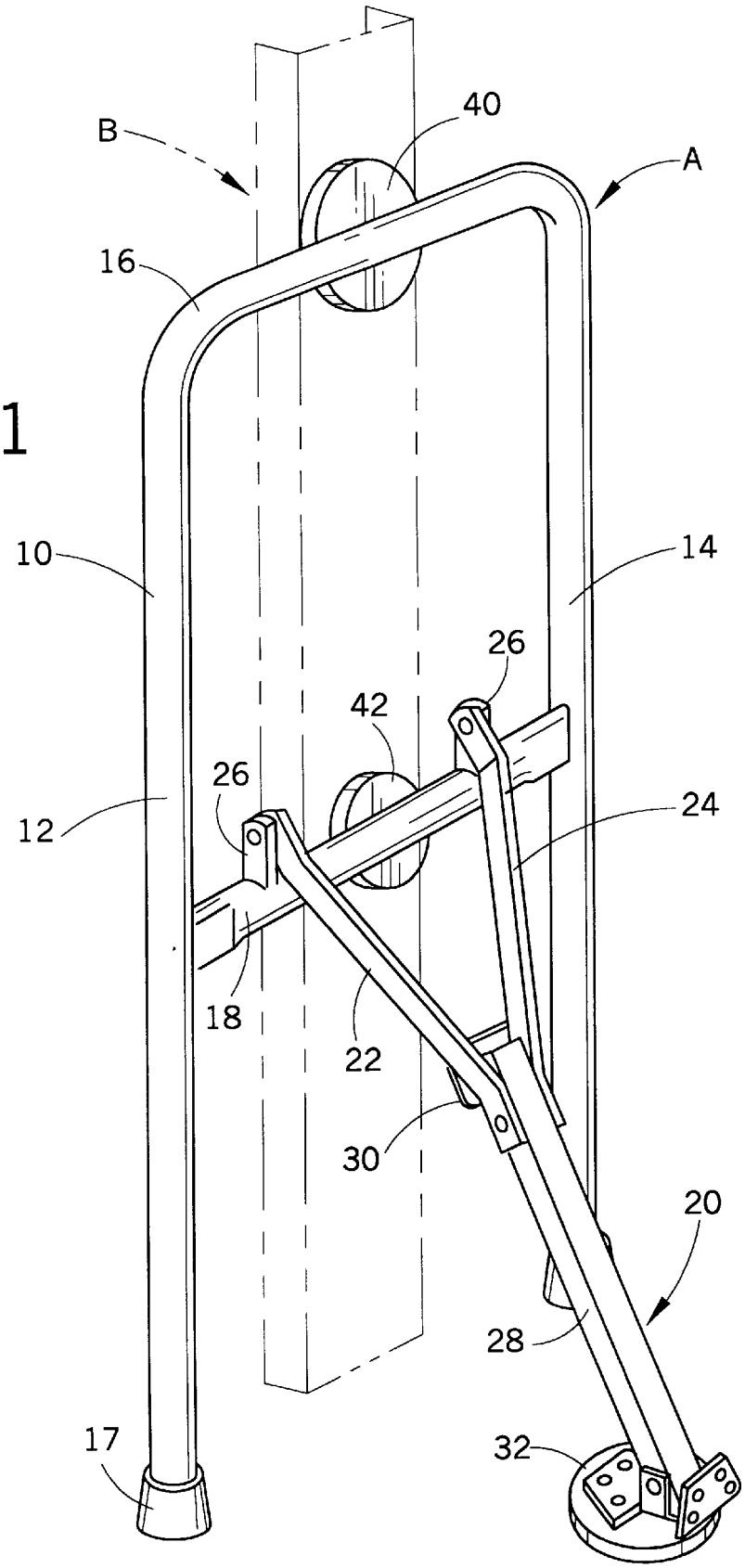
FIG. 1 is a perspective view of a metal stud holding device in accordance with a preferred embodiment of the present invention.

FIG. 1 shows a metal stud holding device A in accordance with the present invention. The metal stud holding device A can be used for aligning and securing a metal stud B in a vertical orientation. The metal stud is positioned in upper and lower tracks (not shown) and then bolted or otherwise secured into position.

As shown in FIG. 1, the metal stud holding device of this invention includes a frame 10, which preferably is U-shaped with a pair of longitudinal members 12, 14 extending from a first cross member 16 in a spaced-apart, generally parallel relation to each other. Preferably, rubber feet 17 are secured to the distal ends of members 12, 14. The frame 10 further includes a second cross member 18 located at an intermediate position between the longitudinal members 12, 14. The second cross member 18 extends from one side of the frame 10 to another about half way up the frame 10.

The metal stud holding device of this invention further includes a base member 20, which is adapted to engage a lower stud track (not shown) that lies horizontally on the floor. The base member 20 is connected to the frame 10. The frame 10 is movable relative to the base member 20 to position the metal stud substantially orthogonal to the stud track.

The pair of longitudinal members 12, 14 and the first cross member 16 preferably comprise a one piece U-shaped member. The metal stud holding device can be a tubular, metal framework that would hold a metal stud in a vertical position in place with a top track and bottom track of a wall partition. The holder can provide the stability and support needed to allow one worker to erect the metal frame of wall partitions.

The base member 20 preferably includes a pair of spaced apart arms 22, 24, which are pivotably connected to the second cross member 18 via brackets 26. Thus, the frame 10 is pivotable with respect to the base member 20. The pair of spaced-apart arms 22, 24 preferably form a Y-shaped base member 20 connected to the brackets 26. The third arm 28 can be pivoted or rotated between a storage or folded position, shown in FIG. 4 and FIG. 5, and a working position, shown in FIG. 2 and FIG. 3. Likewise, the pair of arms 22, 24 are pivoted or rotated about the second cross member 18 between a storage position and a working position.

Figure 3:
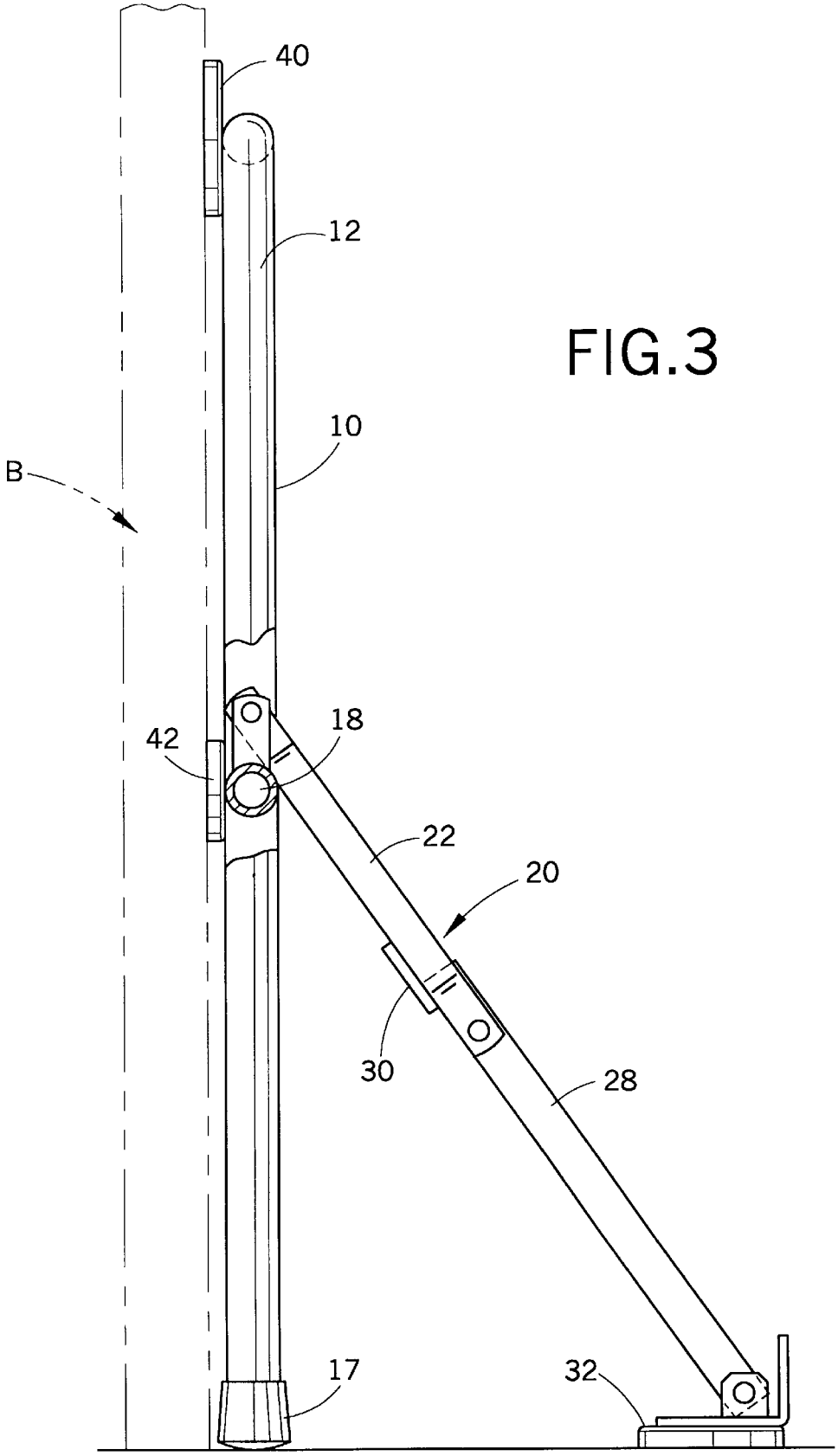
FIG. 3 is a side elevational view of the metal stud holding device of FIG. 1.

A stop plate 30 preferably attached to the base member 20 where the third arm 28 is pivotably attached to the pair of arms 22, 24. As shown in FIG. 3, the stop plate 30 keeps the third arm 28 in alignment with the pair of arms 22, 24 in the same angled position with respect to the frame 10.

The base member 20 preferably includes a base 32 pivotably attached to the third arm 28 and adapted to engage a bottom track of a wall partition (not shown). The base 32 may have a magnetized surface or an adhesive surface. In the presently preferred embodiment of this invention, base 32 comprises a rounded magnet. When secured to the bottom track, the base 32 can serve as a brace, supporting the holder against a vertical stud, and holding the stud in the correct assembly position.

Figure 2:
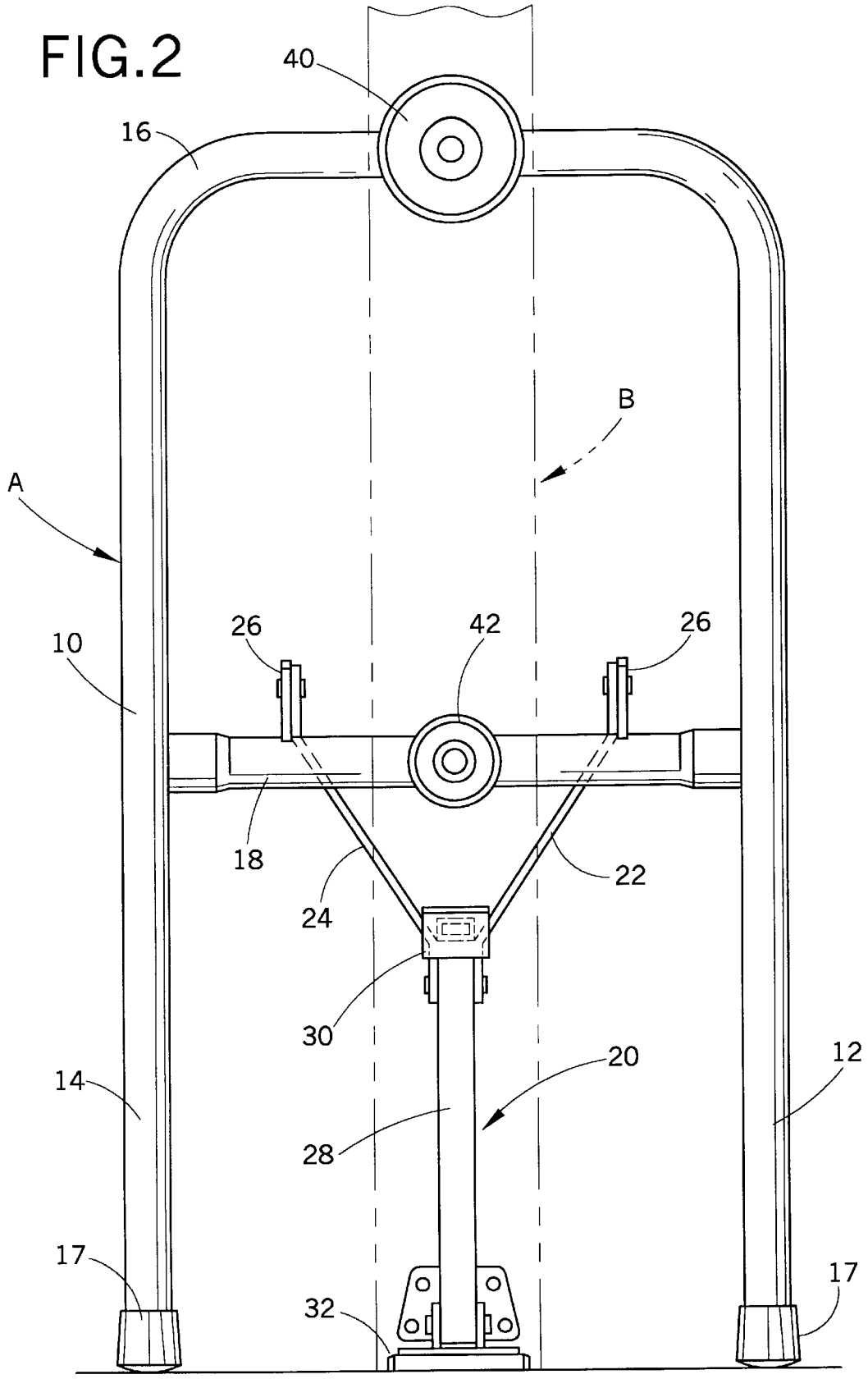
FIG. 2 is a front elevational view of the metal stud holding device of FIG. 1.

Referring now to FIG. 2, the metal stud holding device of this invention further includes a pair of stud magnets 40, 42 secured to the first and second cross members 16, 18, respectively. A strong magnet, such as a shallow pot magnet, preferably is used to ensure attachment of the holder to the metal stud during assembly of the wall partition. Large, round magnets 40, 42 can be mounted in the center of the cross members 16, 18. The two magnets 40, 42 would allow the holder to be mounted flush against a metal stud that was in a vertical position.

The metal stud holding device is easily installed and easily removed away from the stud after use. First, a metal stud is placed in a lower track and is placed in a substantially vertical position. Then, as the worker holds the stud with one hand, the worker manually slides the metal stud holding device against the stud to maintain the stud substantially parallel to the frame 10 in a substantially vertical position. As shown in FIG. 1, the metal stud holding device is pushed against the stud so that the magnets 40, 42 engage the flat surface of the stud wall. The base member 20 is rotated or pivoted outwardly away from the stud such that the third arm 28 is generally parallel with respect to the spaced-apart arms 22, 24. The stop plate 30 keeps the third arm 28 in alignment with the spaced-apart arms 22, 24. The base 32 is then placed into and secured to the bottom track. The base 32 in the preferred embodiment is a rounded magnet which magnetically engages the bottom track. The base 32 serves as a brace supporting the holder against the stud.

The stud is checked for levelness then is bolted or otherwise secured to the lower track while the metal stud holding device is kept in place. An upper track is then placed over and secured to the top of the stud and bolted or otherwise secured into position. The upper track is generally horizontal and parallel to the lower track.

Figure 4:
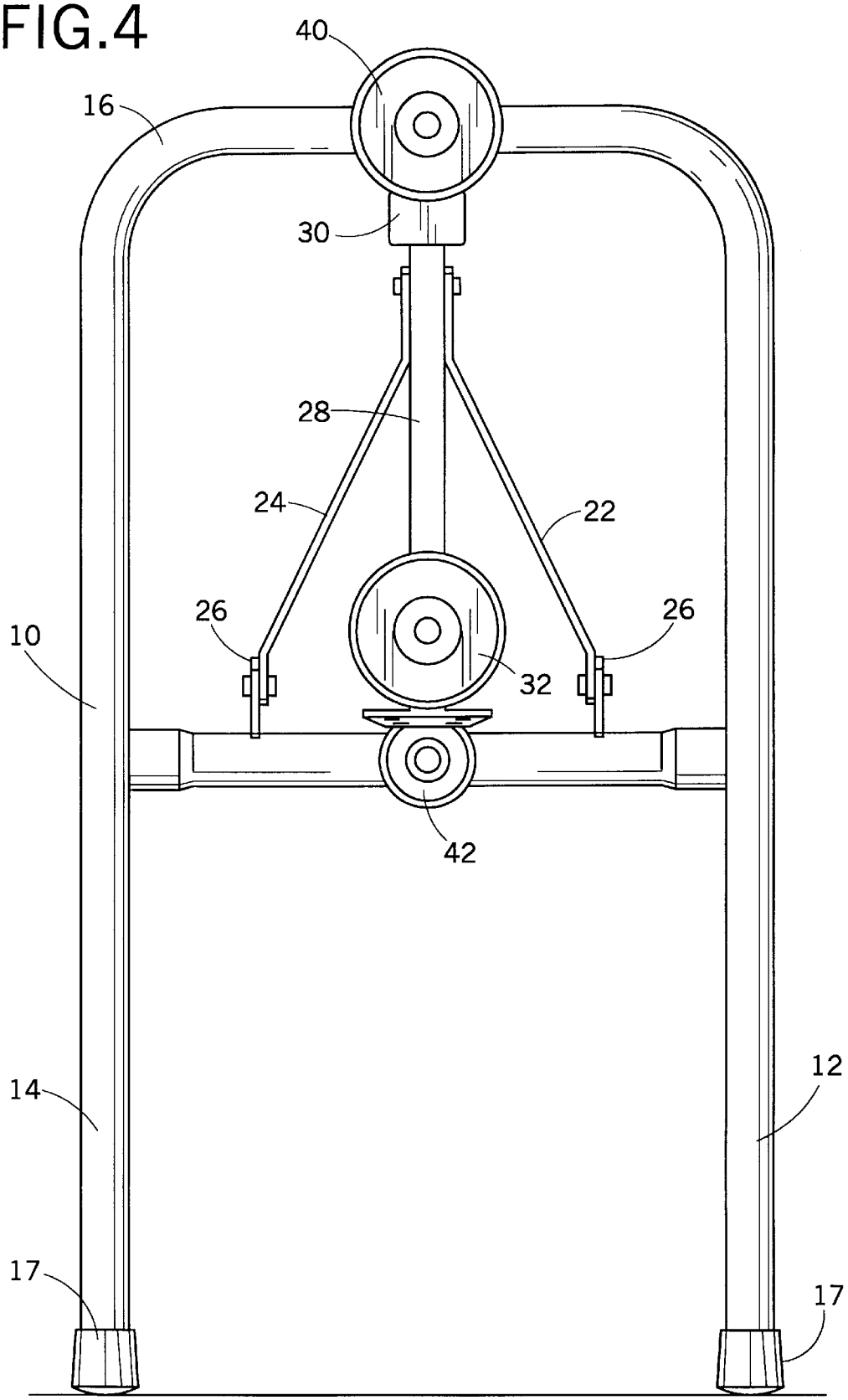
FIG. 4 is a front elevational view of the metal stud holding device of FIG. 1 in a stored or folded position.
Figure 5:
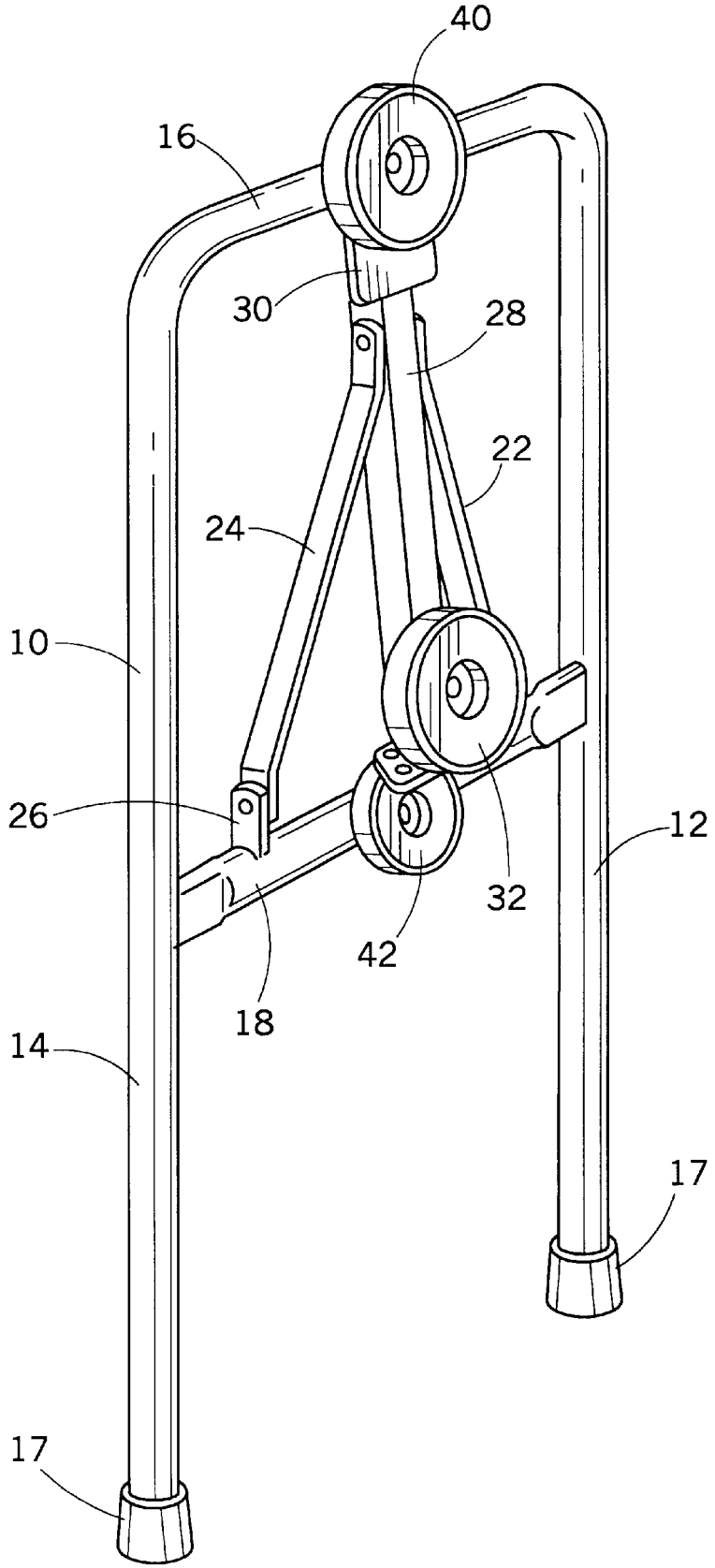
FIG. 5 is a perspective view of the metal stud holding device of FIG. 1 in a stored or folded position.

The metal stud holding device is then pulled away from the stud and the lower track. The arms 22, 24 are rotated upwardly by about the brackets 26 toward the first cross member 16. Then, the third arm 28 is swivelled downwardly at the pivoted connection with the pair of arms 22, 24 until the base 32 is positioned over the stud magnet 42. The holder is then in a folded, or storage position, as shown in FIG. 4 and FIG. 5. The holder is then in a compact position that allows easy removal and storage in a truck or work shed or other area. The holder would typically be fabricated from hardened steel, but would still be light enough to easily carry to a work site and position against a stud.

It will be apparent to those skilled in the art that modifications and variations can be made in the apparatus of the invention without departing from the scope of the invention. For example, a single magnet may be used in place of magnets 40, 42. The invention in its broader aspects is, therefore, not limited to the specific details and illustrated examples shown and described. Accordingly, it is intended that the present invention cover such modifications and variations provided that they fall within the scope of the appended claims and their equivalents.

I claim:

1. An apparatus for holding a metal stud during wall construction comprising:

a base member adapted to engage a stud track; and a frame including:

a stud magnet magnetically engageable with a metal stud, said frame being connected to said base member and movable relative to said base member to position the metal stud substantially orthogonal to said stud track;

a pair of spaced-apart longitudinal members generally parallel to each other; and a first cross member extending between said longitudinal members.

2. The apparatus of claim 1, wherein said base member includes a track magnet magnetically engageable with a metal stud track.

3. The apparatus of claim 1, wherein said frame includes two stud magnets magnetically engageable with the metal stud.

4. The apparatus of claim 1, wherein said frame is pivotably connected to said base member.

5. The apparatus of claim 1, wherein said frame includes a second cross member located at an intermediate position between said longitudinal members, and said base member includes of a pair of spaced-apart arms pivotably connected to said second cross member.

6. The apparatus of claim 5, wherein said base member further includes a third arm pivotably connected to said pair of spaced-apart arms, and said base member is pivotable between a storage position and a working position.

7. An apparatus for holding a metal stud during wall construction comprising:

a base member including a track magnet magnetically engageable with a metal stud track; and an elongated frame including:

at least one stud magnet adapted to hold a metal stud substantially parallel to said frame, said frame being connected to said base member and movable relative to said base member to position the metal stud substantially orthogonal to the stud track;

a pair of spaced-apart longitudinal members generally parallel to each other;

a first cross member extending between said longitudinal members; and a second cross member located at an intermediate position between said longitudinal members.

8. The apparatus of claim 7, wherein said base member includes a pair of spaced-apart arms pivotably connected to said second cross member.

9. The apparatus of claim 8, wherein said base member further includes a third arm pivotably connected to said pair of spaced-apart arms, and said base member is pivotable between a storage position and a working position.

10. An apparatus for holding a metal stud during wall construction comprising:

(a) a frame including:

a pair of spaced-apart longitudinal members generally parallel to each other, a first cross member extending between said longitudinal members, a second cross member located at an intermediate position between said longitudinal members, and at least one stud magnet magnetically engageable with a metal stud, said stud magnet being mounted on one of said cross members; and (b) a base member adapted to engage a stud track and connected to said frame, wherein said frame is movable relative to said base member to position the metal stud substantially orthogonal to said stud track;

wherein said longitudinal members and said first cross member comprise a unitary U-shaped member.

11. The apparatus of claim 10, wherein said base member includes a pair of spaced-apart arms pivotably connected to said second cross member.

12. The apparatus of claim 11, wherein said base member further includes a third arm pivotably connected to said pair of spaced-apart arms, and said base member is pivotable between a storage position and a working position.

13. The apparatus of claim 12, wherein said base member includes a track magnet magnetically engageable with a metal stud track, said magnet mounted on said third arm.

14. The apparatus of claim 10, wherein said frame is pivotably connected to said base member.

15. An apparatus for holding a metal stud during wall construction comprising:

magnetized base means for engaging a metal stud track; and holding means including magnetized means for magnetically engaging a metal stud, said holding means comprising a pair of spaced-apart longitudinal members generally parallel to each other and being connected to said base means and movable relative to said base means to position the metal stud substantially orthogonal to said stud track.

16. The apparatus of claim 15, wherein said base means includes magnetic means for magnetically engaging the metal stud track.

17. The apparatus of claim 16, wherein said holding means is pivotably connected to said base means.

18. A method of erecting a metal stud wall partition, comprising the steps of:

placing one end of a metal stud in a lower stud track;

holding the metal stud in a substantially vertical position by magnetically engaging the metal stud to the frame of a stud holder, the frame of the stud holder including a pair of spaced-apart longitudinal members and being supported in a stable position by a base member engaged with the stud track; and placing the other end of the metal stud in an upper stud track.

19. The method of claim 18, further comprising the step of securing the two ends of the metal stud to the upper and lower stud tracks.

* * * * *